United States Patent [19]

Sowinski

[11] Patent Number: 4,467,580

[45] Date of Patent: Aug. 28, 1984

[54] VENTED INSULATION SYSTEM

[75] Inventor: Gerard T. Sowinski, Lancaster, N.Y.

[73] Assignee: National Gypsum Company, Dallas, Tex.

[21] Appl. No.: 408,909

[22] Filed: Aug. 17, 1982

[51] Int. Cl.[3] ..... E04B 1/70

[52] U.S. Cl. ..... 52/302; 52/409

[58] Field of Search ..... 52/302, 303, 409, 95, 52/407, 169.5, 408, 404

[56] References Cited

U.S. PATENT DOCUMENTS

| | | | |
|---|---|---|---|
| 2,394,380 | 2/1946 | Herbes | 52/748 |
| 3,313,072 | 4/1967 | Cue | 52/303 |
| 3,318,056 | 5/1967 | Thompson | 52/303 |
| 3,343,474 | 9/1967 | Sohda | 52/303 |
| 3,387,420 | 6/1968 | Long | 52/302 |
| 3,455,076 | 7/1969 | Clarvoe | 52/408 |
| 3,619,961 | 11/1971 | Sterrett et al. | 52/302 |
| 4,129,972 | 12/1978 | Sherman et al. | 52/303 |
| 4,277,926 | 7/1981 | Sherman et al. | 52/303 |
| 4,320,613 | 3/1982 | Kaufman | 52/302 |

FOREIGN PATENT DOCUMENTS

| | | | |
|---|---|---|---|
| 712301 | 6/1965 | Canada | 52/302 |
| 2465042 | 3/1981 | France | 52/408 |
| 1206135 | 9/1970 | United Kingdom | 52/302 |

*Primary Examiner*—John E. Murtagh

*Attorney, Agent, or Firm*—Robert F. Hause

[57] ABSTRACT

An insulated exterior building wall structure with a moisture-impervious insulation board on the exterior side of the wall, with moisture venting grooves on the inner surface of the board.

3 Claims, 2 Drawing Figures

VENTED INSULATION SYSTEM

This invention relates to a building exterior wall having a moisture-impervious insulation board which has elongate shallow grooves or raceways on the inner face located suitably for venting water vapor that would otherwise tend to accumulate at the moisture-impervious surface, and deteriorate the adjacent building materials.

U.S. Pat. Nos. 4,129,972 and 4,277,926 disclose two exterior building walls, each of which includes a foam plastic thermal insulation board with vapor barrier characteristics, i.e., with a permeance of less than 1 perm and thus capable of interfering with the passage of moisture. U.S. Pat. No. 4,129,972 discloses the use of special corrugated rigid plastic venting strips in the exterior wall, between floors in a multi-story building and at the top of the wall at the roof line. U.S. Pat. No. 4,277,926 discloses the use of spacer members and closure strips, between the rigid thermal insulating material and the underlying surface. In each case these special added materials are incorporated to permit moisture vapor to escape from the zone immediately inward of the rigid thermal insulating material.

U.S. Pat. No. 3,619,961 discloses what is commonly referred to as a built-up roofing system, which system has therein a rigid foam plastic with oppositely facing grooved surfaces. This grooved plastic is disposed in between two layers of concrete. At least the upper of the two layers contains substantial amounts of excess water, beyond what is necessary for the setting reaction of the concrete, which must escape. Shortly after the upper layer is poured and hardened, a water-impervious layer of bituminous-coated roofing felt is applied over the top, preventing water or water vapor removal from the top surface. The grooves in the top and the bottom surfaces of the rigid foam plastic are intended to permit drying of the two layers of concrete.

The present invention is directed to the use of a grooved-on-one-side-only thermal insulation board with vapor barrier characteristics, in a vertical exterior building wall, to avoid the need for special added materials, to provide moisture vapor escape which otherwise tends to accumulate throughout the life of a building.

It is therefore an object of the present invention to provide a novel wall system embodying a moisture-impermeable board having inherent means for venting moisture vapor which would otherwise tend to accumulate on the inner surface thereof.

It is a further object to provide a novel wall system having a moisture-impermeable board with moisture venting grooves on the inner surface.

These and other objects of the invention will be more readily apparent when considered in relation to the preferred embodiment as set forth in the specification and shown in the drawings in which.

Figure 1:
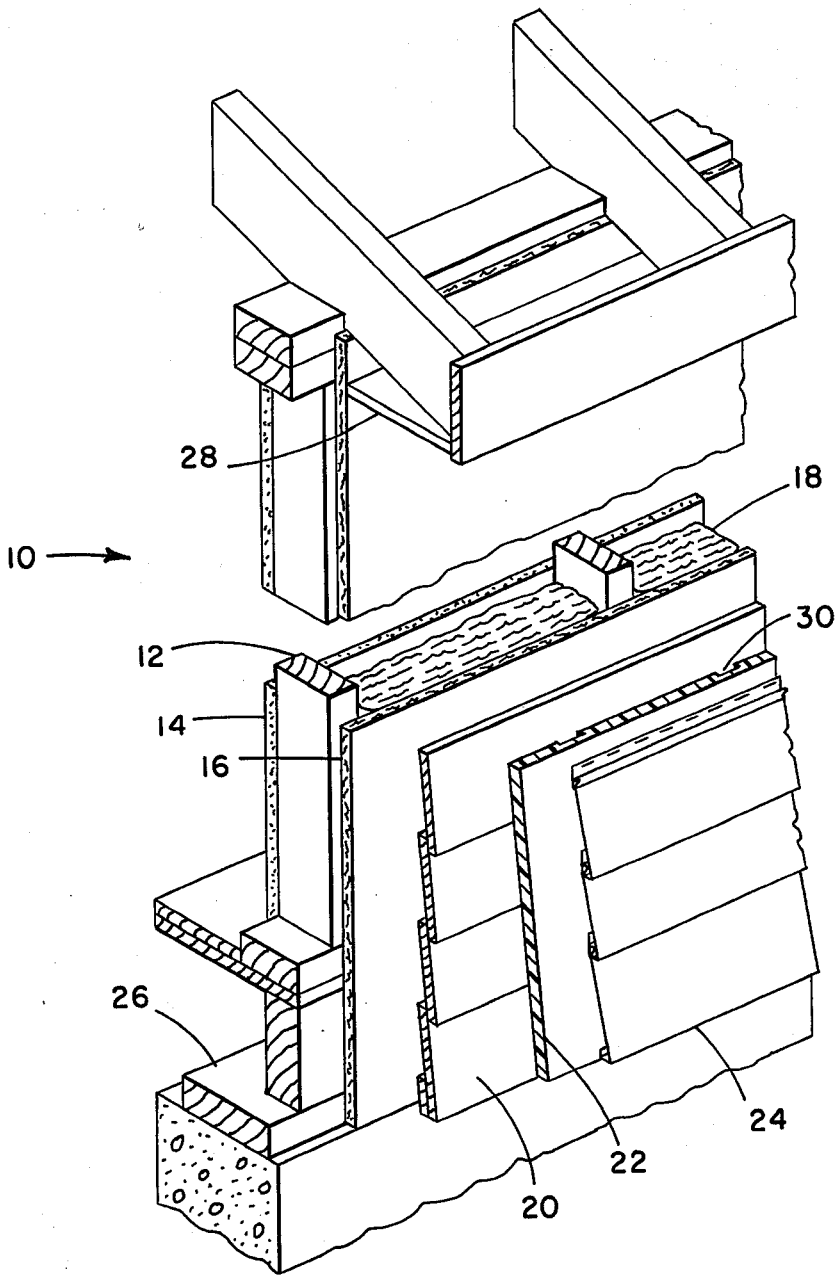
FIG. 1 is an isometric view of a portion of an exterior wall embodying the present invention.

Referring to FIG. 1 there is shown an exterior wall 10 having a plurality of vertical wood studs 12, with gypsum wallboard 14 affixed on the inner side of the studs 12 and exterior sheathing 16 affixed on the outer side of the studs 12. Disposed between each pair of adjacent studs 12, between the wallboard 14 and the sheathing 16 is low density insulation 18, such as blown-in rock wool.

On the outer side of sheathing 16 is old wood lap siding 20. For any of several reasons, the exterior wall has a layer of substantially flat moisture-impermeable plastic foam boards 22 affixed over all of the old wood lap siding, and a new layer of vinyl siding 24 is affixed over the boards 22.

New siding is commonly applied to old houses for any one of several reasons, such as to avoid the need of frequent paintings, to improve the appearance of the building, or to improve the insulation value or wind resistance and the resultant heat efficiency of the building. If the reason is not specifically for the purpose of adding more insulation, it is still commonly necessary to apply some form of flat board as a base over the old siding, prior to applying the new siding, and, accordingly, two functions can then be provided at once by using a plastic foam moisture-impermeable board as the flat board.

The moisture-impermeable boards 22 cover the entire exterior surface of the old siding 20, from the sill 26 to the soffit 28.

Figure 2:
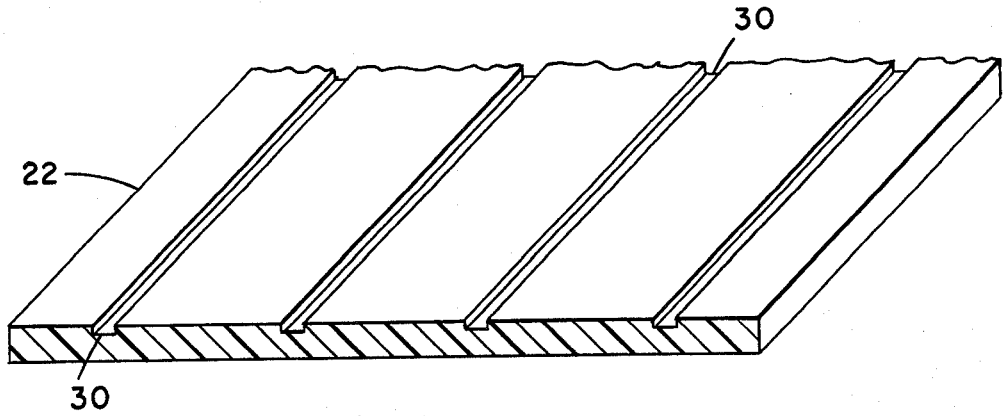
FIG. 2 is an isometric view of the grooved moisture-impermeable board of the wall structure of FIG. 1.

As more clearly shown in FIG. 2, the boards 22 are all formed with a plurality of elongate shallow parallel grooves 30, extending vertically in wall 10, on the one side only of the boards 22 which faces inward, against the old siding 20. Preferably the grooves 30 are about 0.1 inch deep, about one inch wide and spaced in parallel relation at about 12 inches, center to center, providing a spacing to groove width ratio of 12:1.

The grooves 30 provide a means for moisture vapor to escape from any area at the inner surface of the moisture-impermeable board, to the bottom or the top of the wall and thence to the atmosphere, without the need for special spacers in the construction of the exterior wall.

Having completed a detailed disclosure of the preferred embodiment of my invention so that those skilled in the art may practice the same, I contemplate that variations may be made without departing from the essence of the invention or the scope of the appended claims.

I claim:

1. An insulated, exterior, vertical building wall comprising substantially moisture-impermeable, substantially flat boards mounted adjacent the exterior surface of said wall forming a substantially unbroken layer within said wall, said moisture-impermeable boards each having an inwardly directed side disposed firmly against inwardly disposed elements of said wall, said moisture-impermeable board having a plurality of spaced parallel elongate shallow moisture venting grooves extending from one edge to an opposite edge on only said one side thereof which is disposed against said inwardly disposed elements of said wall, said shallow grooves having a spacing between them substantially greater than the groove widths with ungrooved areas between said grooves forming a major portion of said inwardly directed side, said wall further comprising spaced vertical framing members, interior face forming members on the interior side of said framing members, relatively old siding forming a substantially continuous surface on the exterior side of said framing members, said substantially moisture-impermeable boards mounted externally of and against said relatively old siding, and relatively new siding applied over said moisture-impermeable boards.

2. An insulated, exterior wall as defined in claim 1 wherein said moisture-impermeable boards are low density plastic foam, and said grooves are about an inch wide and about 0.1 inch deep.

3. An insulated, exterior wall as defined in claim 2 wherein said grooves are disposed in a substantially vertical extent, and have a spacing to groove width ratio of about 12:1.

* * * * *